US007647716B2

(12) United States Patent
Finkle

(10) Patent No.: US 7,647,716 B2
(45) Date of Patent: Jan. 19, 2010

(54) LIQUID MOTION LAMP POINT OF SALE DISPLAY

(76) Inventor: Louis J. Finkle, 3300 E. 59th St., Long Beach, CA (US) 90805

( * ) Notice: Subject to any disclaimer, the term of this patent is extended or adjusted under 35 U.S.C. 154(b) by 0 days.

(21) Appl. No.: 12/025,466

(22) Filed: Feb. 4, 2008

(65) Prior Publication Data

US 2008/0184605 A1 Aug. 7, 2008

Related U.S. Application Data

(60) Provisional application No. 60/899,152, filed on Feb. 2, 2007.

(51) Int. Cl.
*G09F 19/00* (2006.01)

(52) U.S. Cl. ..... 40/406; 40/409

(58) Field of Classification Search ..... 40/409, 40/406; 362/101, 96, 318; 315/149, 159, 315/158

See application file for complete search history.

(56) References Cited

U.S. PATENT DOCUMENTS

| | | | | |
|---|---|---|---|---|
| 3,387,396 | A | 6/1968 | Smith | |
| 3,570,156 | A | 3/1971 | Walker | |
| 3,819,924 | A * | 6/1974 | Thomas et al. | 40/554 |
| 4,273,992 | A * | 6/1981 | Thomas | 219/521 |
| 4,419,283 | A | 12/1983 | Schneider | |
| 5,778,576 | A * | 7/1998 | Kaviani | 40/409 |
| 6,604,835 | B2 | 8/2003 | Zale | |
| 6,681,508 | B2 | 1/2004 | Unger et al. | |
| 6,703,786 | B2 * | 3/2004 | Tannenbaum | 315/149 |
| 6,746,131 | B1 | 6/2004 | Goldstein | |
| 6,913,369 | B2 | 7/2005 | Chadwick | |
| 7,137,720 | B1 | 11/2006 | Finkle | |
| 2003/0202340 | A1 | 10/2003 | Wu | |
| 2007/0291472 | A1 | 12/2007 | Finkle | |

FOREIGN PATENT DOCUMENTS

| | | |
|---|---|---|
| GB | 2 399 446 | 9/2004 |
| JP | 2005-19410 A | 2/2005 |
| JP | 2005-142102 A | 2/2005 |
| JP | 17019410 | 2/2005 |
| JP | 17142102 | 2/2005 |

* cited by examiner

*Primary Examiner*—Cassandra Davis
(74) *Attorney, Agent, or Firm*—Kenneth L. Green; Edgar W. Averill, Jr.

(57) ABSTRACT

A point of sale display combines clear shelves with a visually attractive and attention holding liquid motion lamp background. The liquid motion lamp combines motion to attract the attention of shoppers with an ever changing display of color and light to hold the shopper's attention. The rising and descending patterns are unique and random and thereby hold the shopper's attention for long periods of time obtaining valuable exposure of products displayed on the shelves.

19 Claims, 4 Drawing Sheets

LIQUID MOTION LAMP POINT OF SALE DISPLAY

The present application claims the priority of U.S. Provisional Patent Application Ser. No. 60/899,152 filed Feb. 2, 2007, which application is incorporated in its entirety herein by reference.

BACKGROUND OF THE INVENTION

The present invention relates to point of sale displays and in particular to a point of sale display incorporating a liquid motion lamp providing an ever changing combination of lighting, motion, and color to attract and hold the attention of shoppers.

Point of sale displays are used in almost all sales environments. Such displays may range from simple shelves allowing the products to be displayed in an organized manner to elaborate constructions creating a fanciful setting for the products. The elaborate, and often expensive, displays demonstrate the value sellers place on attracting and holding a shopper's attention. Unfortunately, shoppers have been exposed to such elaborate and extensive displays to a degree that most displays are ignored. There is thus a need for a point of sale display which both attracts and holds the attention of shoppers.

Liquid motion lamps, or lava lamps, are well known as small home decorative lighting. U.S. Pat. No. 3,387,396 for "Display Devices," U.S. Pat. No. 3,570,156 for "Display Devices," and U.S. Pat. No. 5,778,576 for "Novelty Lamp," describe such lamps. A detailed description of liquids used in such lamps is provided in U.S. Pat. No. 4,419,283 for "Liquid compositions for display devices." Such lamps are very limited in size and only suitable for residing on shelves and tables, generally residential, as a conversation piece. The '396, '156, '576, and '283 patents are herein incorporated by reference While the decorative qualities of liquid motion lamps have been long known, such known lamps are small and provide inconsistent performance. Known lamp materials (the liquid composition in the lamps) is added to the lamps at a manufacturing location, and large liquid motion lamps were not available because of shipping difficulties and locating and relocating difficulties resulting from the large amount of liquid lamp materials in the lamps. As a result, large liquid motion lamps suitable for point of sale displays were not available for commercial use.

U.S. Pat. No. 7,137,720 for "Liquid Motion Lamp," filed by the present applicant, discloses a method for preparing a first lamp material suitable for use in a large liquid motion lamp. The first lamp material is a solid at room temperature and a liquid at a lamp operating temperature. The first lamp material is adapted to cooperate with a second lamp material, which second lamp material is a liquid at room temperate and is preferably water. The first lamp material has a higher density than the second lamp material at room temperature and a lower density than the second lamp material at the lamp operating temperature. The first lamp material and methods disclosed in the '720 patent allow a large liquid motion lamp, as tall as nine feet tall, to be constructed and shipped with a small amount of the first lamp material, and a much larger amount of the second lamp material to be added to the liquid motion lamp at a final location, thus making large liquid motion lamps practical for shipping. The '720 patent is herein incorporated in its entirety by reference.

While the '720 patent made shipping large liquid motion lamps practical, such large lamps may fail to consistently perform as desired because of difficulty of open loop heating to maintain a desired operating temperature. The first and second lamp materials within the lamps would often fail to produce the intended patterns and motion thereby failing to produce the desired visual effect, and higher than necessary temperatures can significantly shorten the life of the first lamp material in the lamp by accelerating chemical reactions. U.S. patent application Ser. No. 11/605,779 for "Control System for Liquid Motion Lamp," filed by the present applicant, discloses a closed loop control system for liquid motion lamps which both maintains the desired behavior of the first and second lamp materials in the lamps, and extends the life of the first lamp material by preventing higher than necessary temperatures. The '779 application is herein incorporated in its entirety by reference.

BRIEF SUMMARY OF THE INVENTION

The present invention addresses the above and other needs by providing a point of sale display combining clear shelves with a visually attractive and attention retaining liquid motion lamp background. The liquid motion lamp combines motion to attract the attention of shoppers with an ever changing display of color and light to hold the shopper's attention. The rising and descending patterns are unique and random and thereby hold the shopper's attention for long periods of time obtaining valuable exposure of products displayed on the shelves.

In accordance with one aspect of the invention, there is provided a point of sale display having a liquid motion lamp as a center attracting feature. The liquid motion lamp comprises a lamp base portion, a clear container, and a top piece. Three round shelves reside concentric to the liquid motion lamp. The lamp base portion includes a base flange supported by a horizontal surface, a base ring supported above the base flange, a cylindrical base cover covers the base ring, and electronics providing light and heat. The clear container extends vertically upward from the base ring and is supported by the base ring and receives the light and heat from the base portion. First and second lamp materials reside in the container and are adapted to cooperate wherein the first lamp material has a greater density than the second lamp material at room temperature, and a lower density than the second lamp material at a higher temperature. The light and heat provided by the lamp base portion cooperates thermally with the first and second lamp materials to heat the first and second lamp materials. Heating the lamp materials causes a portion of the first lamp materials residing proximal to the lamp base portion to agglomerate forming globules which rise proximal to the top piece within the second lamp material. The second lamp material then cools and falls within the second liquid back to the lamp base portion resulting in an ever-changing display of motion within the container. The three round shelves reside concentric to the liquid motion lamp and the ever-changing shapes and motion of the liquids within the liquid motion lamp uniquely draw and hold shopper's attention to products on the shelves.

In accordance with another aspect of the invention, there is provided a method for locating and relocating a point of sale display. The method includes transporting an essentially dry liquid motion lamp containing a solid phase first lamp material to a point of sale, adding a liquid phase second lamp material to the lamp at the point of sale, positioning shelves proximal to the lamp to construct a point of sale display, heating the first and second lamp materials, closed loop controlling a temperature of the lamp to provide an ever changing display of shapes and motion to attract and hold the attention of shoppers, removing heat from the lamp and allowing the lamp to cool, removing the liquid phase second lamp material from the lamp, disassembling the point of sale display, and relocating the liquid motion lamp and shelves to a second point of sale location and reassembling the point of sale display.

In accordance with yet another aspect of the invention, there is provided a large locatable and relocatable point of sale display including a liquid motion lamp for attracting and holding the attention of shoppers. Advantageously, if the liquid motion lamp according to the present invention is allowed to cool to room temperature, a first lamp material will settle to the bottom in a solid phase and a second lamp material (still in a liquid phase) may be removed. The point of sale display including the liquid motion lamp may then be relocated and the liquid motion lamp refilled with the liquid phase second lamp material. The present invention recognizes the significant advantage of being able to locate and relocate a suitably large liquid motion lamp in a point of sale application.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
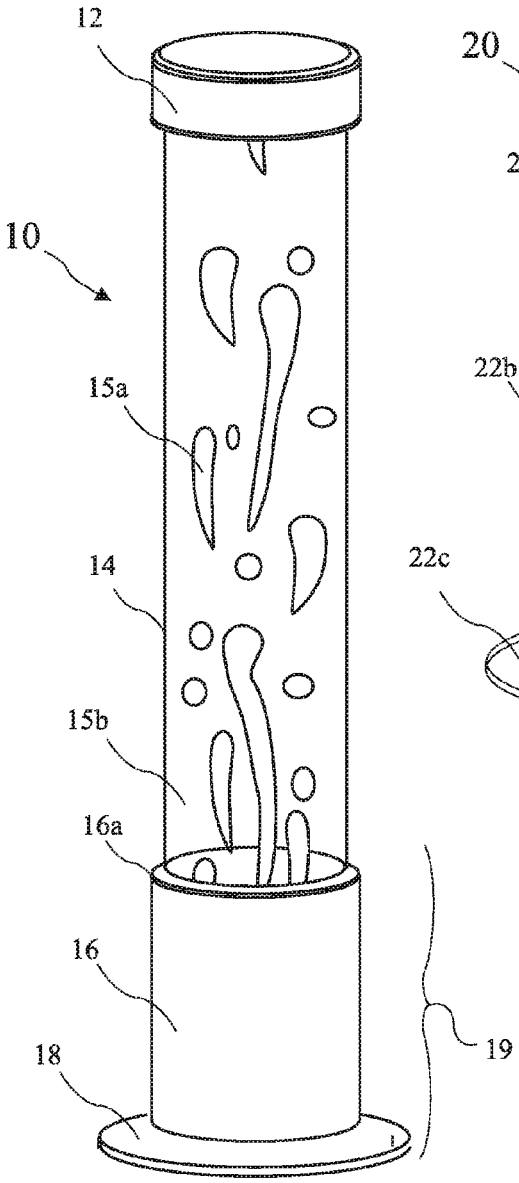
FIG. 1 is a liquid motion lamp.

A known large liquid motion lamp 10 is shown in FIG. 1. The liquid motion lamp 10 includes a top piece 12, a container 14, and a base portion 19 including a base cover 16 and a base flange 18. A first lamp material 15*a* and a second lamp material 15*b* reside inside the container 14. The first lamp material 15*a* is a solid at room temperature and is preferably a liquid at and above a lower lamp operating temperature, and is adapted to cooperate with the second liquid 15*b*, which is a liquid at room temperature. The first lamp material 15*a* has a higher density than the second lamp material 15*b* at the lower lamp operating temperature and a lower density than the second lamp material at a second higher lamp operating temperature. The first lamp material 15*a* is generally colored and the second lamp material 15*b* is generally, but not necessarily, clear, and is preferably water. The first lamp material 15*a* is formulated to form globules of various size and shape which rise in the second lamp material 15*b* from the heated bottom of the container 14 and cool near the container top piece 12 and then fall back through the second lamp material 15*b* to the bottom of the container 14. The resulting ever changing visual effects are random and visually attractive and retentive. A liquid state of the first lamp material 15*a* near the lower lamp operating temperature is not a requirement of the liquid motion lamp 10, and a liquid motion lamp wherein the first lamp material 15*a* become solid or semi solid at the lower lamp operating temperature is intended to come within the scope of the present invention.

The container 14 is preferably transparent and more preferably made from borosilicate glass or any clear stable plastic, such as acrylic or polycarbonate. The top piece 12 and base portion 19 are preferably made from cast aluminum. The container 14 preferably extends into the base portion 19 and elements of the base portion 19 support the container 14 in a vertical attitude.

The diameter of the container 14 is preferably between about six inches and about thirty-six inches. The base portion 16 preferably has a diameter of between about the diameter of the container 14 and about two inches greater than the diameter of the container 14. In embodiments having a base flange 18, the diameter of the base flange 18 is preferably between about one inch and six inches greater than the diameter of the container 14 and the footprint of the base flange 18 may be increased in size to provide additional support to the lamp 10. The overall height of the liquid motion lamp 10 is preferably between about three feet and about nine feet, and more preferably is about seven feet.

Because the lamps 10 are displayed in various environments with varying ambient temperature and various air flow, the closed loop temperature control disclosed in the '267 patent application is preferably incorporated into the base portion 19. Such temperature control generally includes a sensor which may be inside the container 14 or outside the container 14, and may be a remote sensor. The lamp 10 generally includes a light 32 (see FIG. 6) which provides both light and heat, and a second heating element providing only heat. Further details of the closed loop temperature control are disclosed in the '267 patent application.

Figure 2:
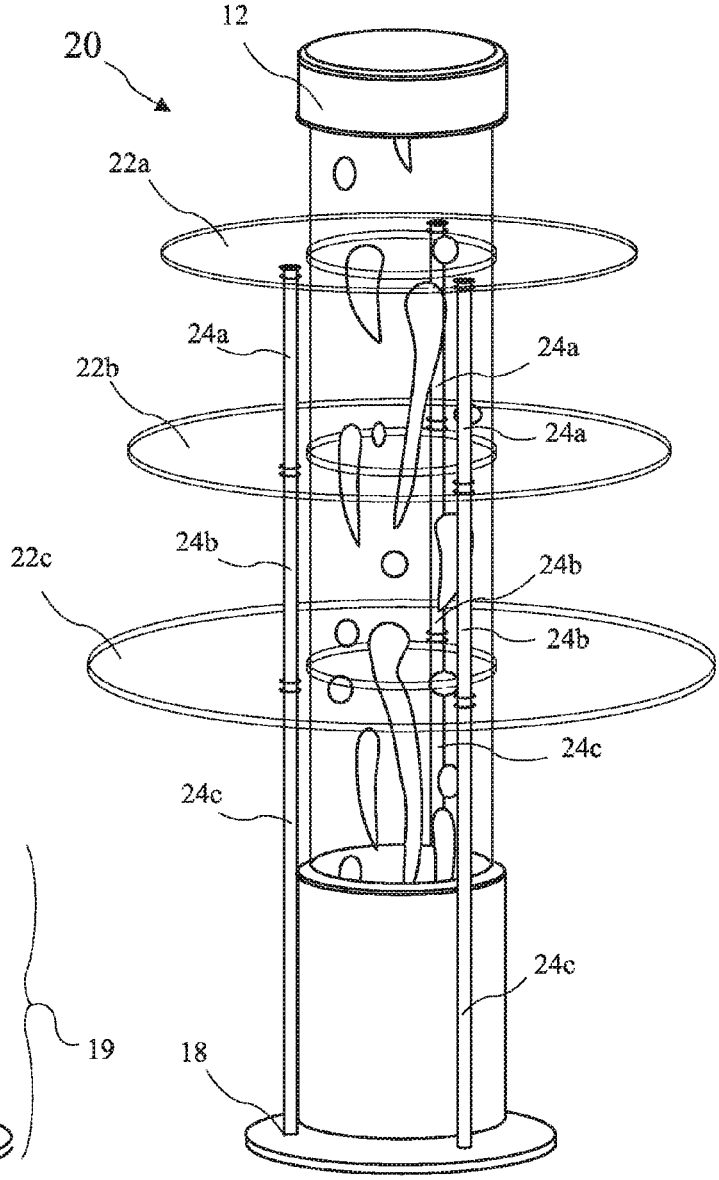
FIG. 2 is a point of sale display according to the present invention comprising the liquid motion lamp and shelves residing around the liquid motion lamp.

The liquid motion lamp 10 is preferably for use in a commercial setting, such as building lobbies, clubs, lounges, and salons. As such, the relatively large overall dimensions of the preferred embodiment, especially as compared to traditional lava lamp designs, permit the liquid motion lamp 10 to be used in conjunction with or as part of, a point of sale display 20 according to the present invention, as shown in FIG. 2. The point of sale display 20 includes the liquid motion lamp 10 and one or more product display shelves 22*a*, 22*b*, and 22*c* comprising tiered surfaces. The shelves 22*a*, 22*b*, and 22*c* are preferably clear to allow viewing the liquid motion lamp 10 to the greatest extent, and are shown supported by vertical posts 24*a*, 24*b*, and 24*c*, but may be supported by any appropriate support. Multiple shelves are preferably concentrically arranged about one liquid motion lamp 10, but in other embodiments, a point of sale display according to the present invention may comprise one or more liquid motion lamps as a background for display shelves, for example, a row of liquid motion lamps behind display shelves. The shelves 22*a*, 22*b*, and 22*c* may carry, for example, bottles of shampoo, wine bottles, figurines, books, magazines—nearly anything that would benefit from being displayed in an eye-catching fashion.

Figure 3:
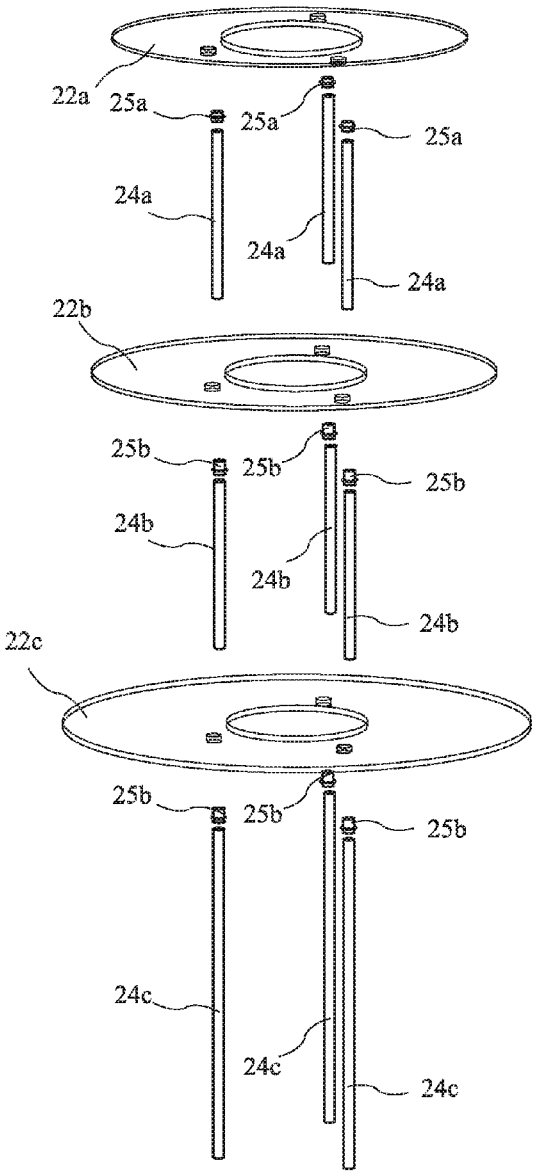
FIG. 3 is an exploded view of the shelves and shelf support posts according to the present invention.
Figure 4:
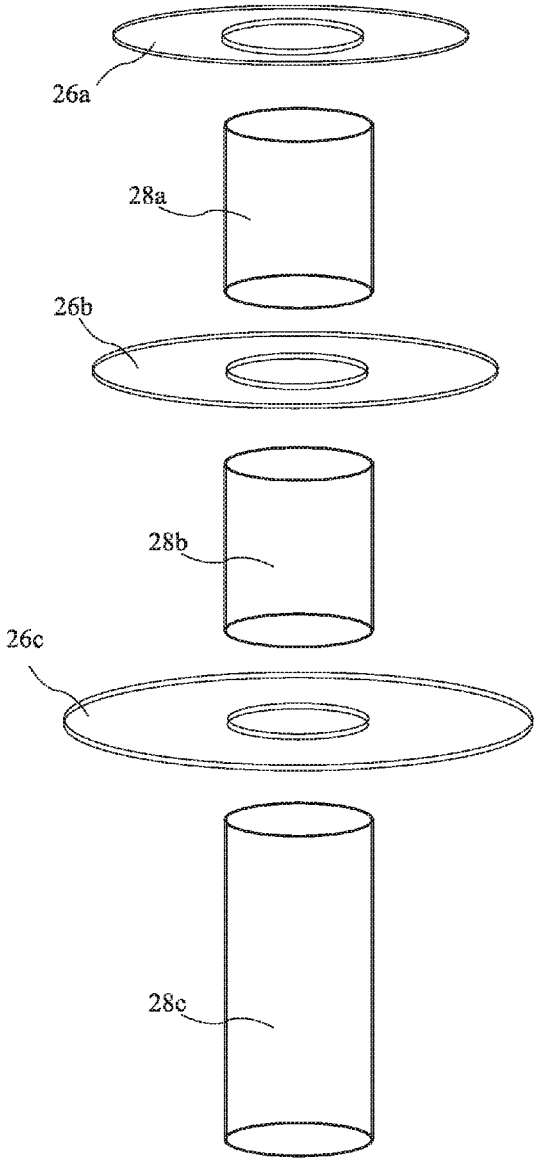
FIG. 4 is an exploded view of an embodiment of the present invention comprising shelves and clear spacing cylinders according to the present invention.

An exploded view of the shelves 22*a*, 22*b*, and 22*c* and sets of the vertical posts 24*a*, 24*b*, and 24*c*, is shown in FIG. 3, and an exploded view second shelves 26*a*, 26*b*, and 26*c* and clear spacing cylinders 28*a*, 28*b*, and 28*c* is shown in FIG. 4. The sets of vertical posts 24*a*, 24*b*, and 24*c* comprise sequential sets of at least three parallel vertical posts each, to support the shelves 22*a*, 22*b*, and 22*c*. The lower most set of vertical posts 24*c* is supported by the base flange 18 and extend vertically upward to support the lower most shelf 22*c*. The next set of vertical posts 24*b* extend vertically upward from the lower most shelf 22*c* to support the center shelf 22*b* and are supported by the lower most shelf 22*c* or by the lower most posts 24*c* directly. The upper most posts 24*a* extend vertically upward from the center shelf 22*b* to support the upper most shelf 22*a* and are supported by the center shelf 22*b* or sequentially by the lower most posts 24*c* and the center posts 24*b* directly. First couplings 25*a* reside between the vertical posts 24*a* and the shelf 22*a*. Second couplings 25*b* reside between the second posts 24*b* and first posts 24*a* supporting the second shelf 22*b*, and between the third posts 24*c* and second posts 24*b* supporting the third shelf 22*c*. The couplings 25*a* and 25*b* include cylindrical portions passing through the shelves 22*a*, 22*b*, and 22*c* and into the posts 24*a*, 24*b*, and 24*c*, and support rings for supporting the shelves 22*a*, 22*b*, and 22*c*. The shelves 22*a*, 22*b*, and 22*c* may or may not touch the container 14.

The clear spacing cylinders 28*a*, 28*b*, and 28*c* reside outside the container 14. The lower most clear spacing cylinder 28*c* preferably rest on an upper edge of a base ring 35 (see FIG. 5) inside the base cover 16 allowing the base cover 16 to be raised to access electronics inside the base portion 19, but may also reside on an upper edge 16*a* of the base cover 16, or on a support flange 17 (see FIG. 5) resting on the upper edge 16*a* (see FIG. 1). The lower most shelf 22*c* rests on the lower most clear spacing cylinder 28*c*. The center clear spacing cylinder 28*b* rests on the lower most shelf 26*c* and the center shelf 26*b* rests on the center clear spacing cylinder 28*b*. The upper most clear spacing cylinder 28*b* rests on the center shelf 26*b* and the upper most shelf 26*a* rests on the upper clear spacing cylinder 28*a*.

Figure 5:
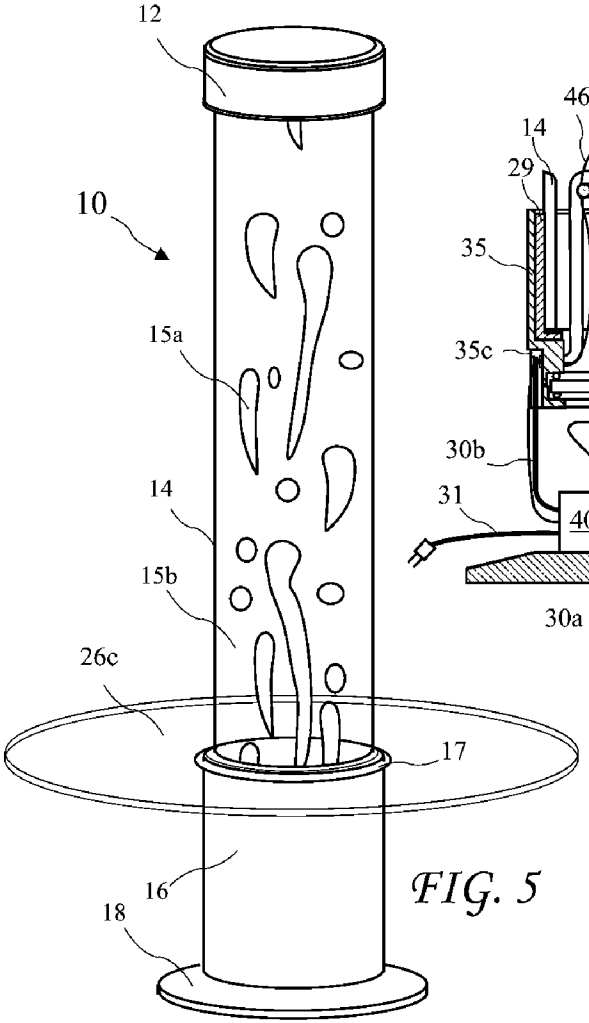
FIG. 5 shows an embodiment of the present invention having a shelf supported by a base portion of the liquid motion lamp according to the present invention.

An embodiment of the present invention having the shelf 26*c* supported by the base portion 19 of the liquid motion lamp 10 is shown in FIG. 5. The shelf 26*c* may reside on an upper edge of the base cover 16 directly, or on a support flange 17 resting on the upper edge 16*a* (see FIG. 1) of the base cover 16. The center and upper spacing cylinders 28*b* and 28*a*, and the center and upper shelves 26*b* an 26*a* may reside on the lower shelf 26*c* to provide a tiered point of sale display, or the point of sale display may only include the lower most shelf 26*c*.

Because of the size and weight of the point of sale display 20 and the liquid motion lamp 10 in particular, it is very useful to provide access to electronics in the base portion 19. A preferred way to provide such access is allow the base cover 16 to slide vertically as shown by arrow 38 in FIG. 6. Such access allows, for example, routine replacement of the light 32 connected to a light receptacle 34. Alternatively, the base cover 16 may separate into two halves to remove and gain access to the electronics, or may include a door which may open to obtain access to the electronics. A base ring 35 supports the container 14 and is preferably supported by three spaced apart vertical supports 36 allowing access to electrical elements of the liquid motion lamp 10.

Figure 6:
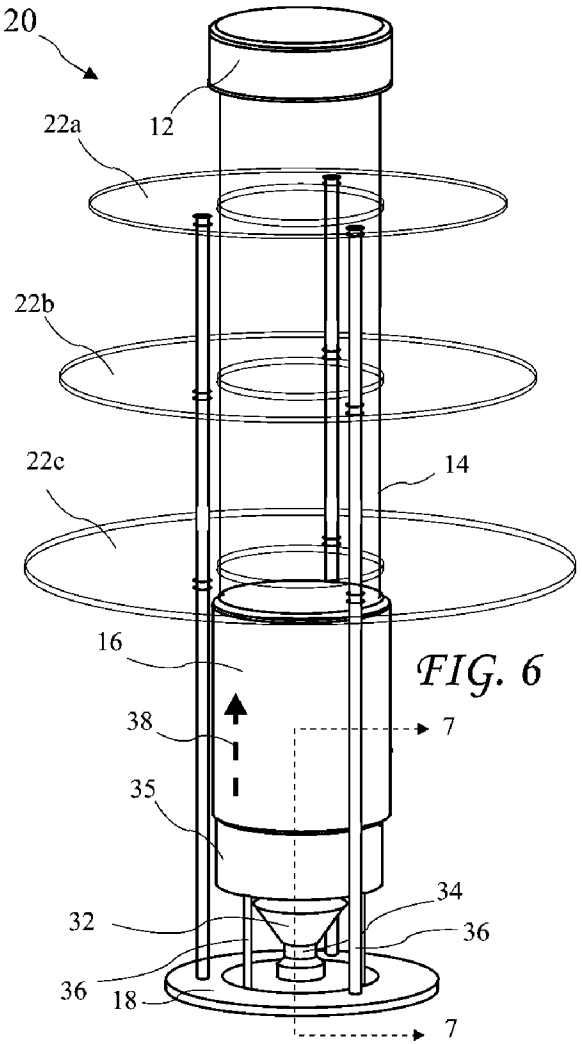
FIG. 6 shows the point of sale display with a base cover lifted for access to lighting and heating elements of the liquid motion lamp.
Figure 7:
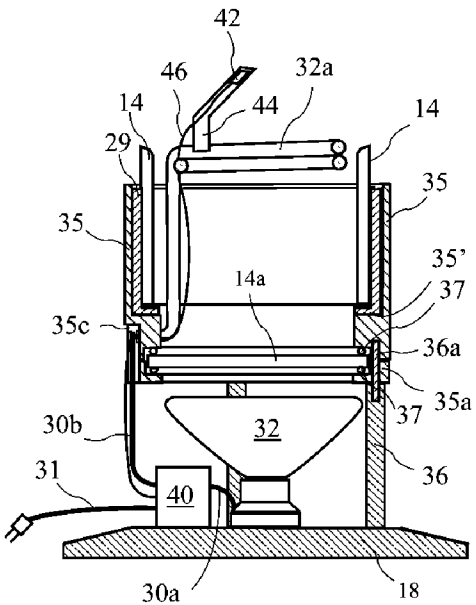
FIG. 7 is a cross-sectional view of the base portion of the liquid motion lamp taken along line 7-7 of FIG. 6 showing a closed loop heating system for the liquid motion lamp.

A detailed cross-sectional view of the bottom portion 19 of a preferred embodiment of the liquid motion lamp 10, taken along line 7-7 of FIG. 6, is shown in FIG. 7. The container base 35 surrounds and supports the bottom of the container 14. The container base 35 includes a shelf 35' reaching under a lower edge of the container 14 to provide vertical support to the container 14. A sealing material 29 resides between vertical walls of the container base 35 and the container 14, and between the bottom edge of the container 14 and the shelf 35'. The container base 35 cooperates with a base ring 35*a* to sandwich a container bottom 14*a*. Seals, which are preferably O-rings 37, reside between the bottom 14*a* and the container base 35 and between the bottom 14*a* and the base ring 35*a*. The supports 36 (also see FIG. 5) are preferably attached to the container base 35 using support studs 36*a*, passing through the base ring 35*a*, thereby joining the base ring 35*a* to the container base 35, and compressing O-rings 37. The container bottom 14*a* is preferably fabricated from a transparent material suitable to pass light from the light 32 into the container 14, and the container bottom 14*a* is more preferably made from the same material as the container 14 described above. A recess 35*c* in the container base 35 and base ring 35*a* provide space for the wires 30*b* and 46 to pass downward inside the base cover 16.

Continuing with FIG. 7, electronics (or electrical circuit) 40 providing power to the light 32 (which also generally provides heat) and to a second heater 32*a* are housed in the base portion 19 (see FIG. 1). A temperature sensor 42 is shown attached to the second heater 32*a* and positioned to reside inside the bottom of the container 14. An important advantage of attaching the sensor 42 to the second heater 38 is an ability to sense an empty container 14 by high temperature measurements. Other temperature sensors include but are not limited to any sensor inside the container 14, a sensor on the outside of the container 14, or a remote sensor (e.g., an infrared sensor). Wires 46 carry a temperature signal generated by the temperature sensor 42 to the electronics 40. The electronics 40 receive power through a cord 31 and provide a closed loop controlled power signal to the light 32 through wires 30*a* and the second heater 38 through wires 30*b*.

Figure 8:
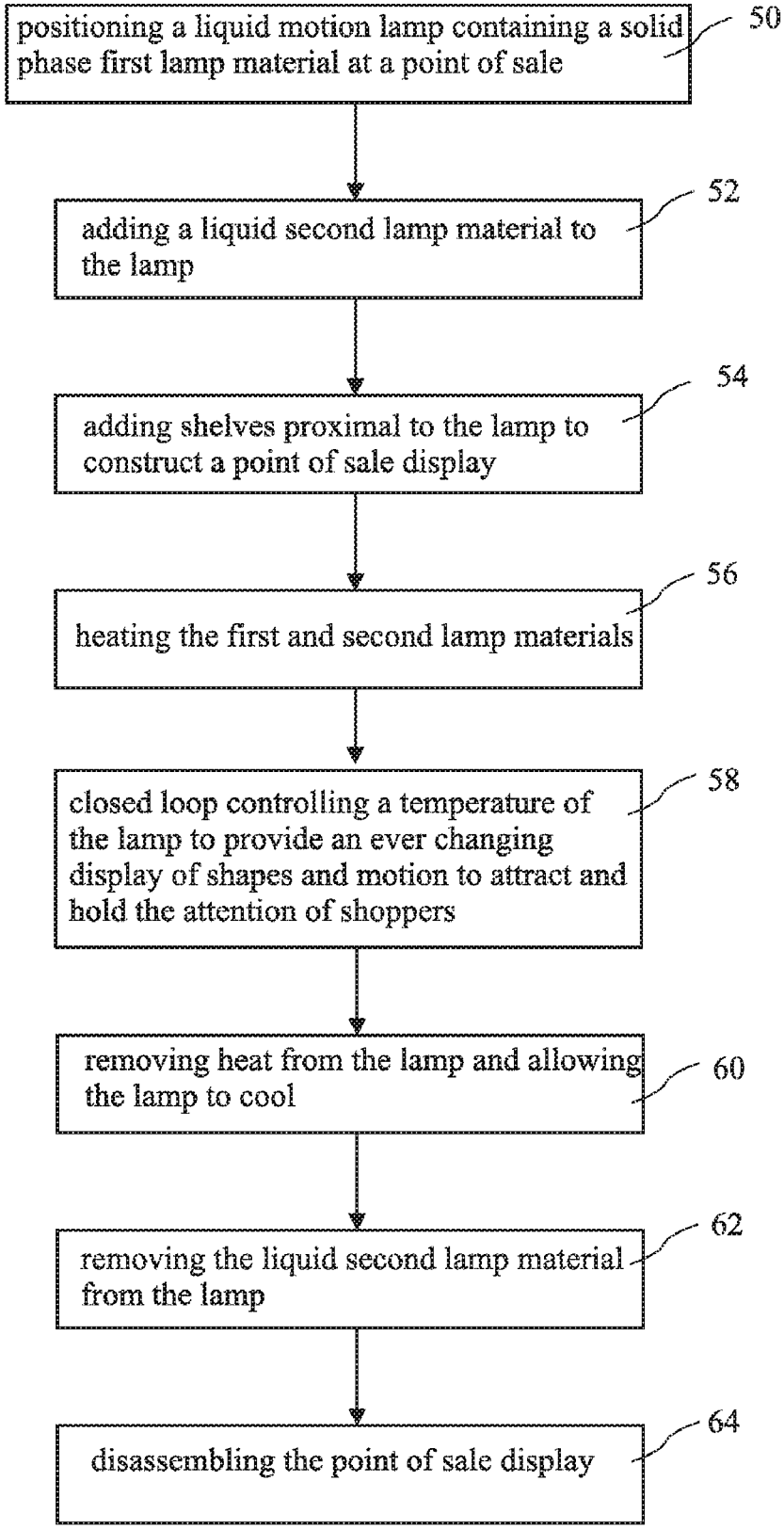
FIG. 8 describes a method for assembling, using, and disassembling a point of sale display.

A method for locating and relocating a point of sale display including a suitably large liquid motion lamp according to the present invention is described in FIG. 8. The method includes positioning a liquid motion lamp containing a solid phase first lamp material at a point of sale at step 50, adding a liquid phase second lamp material to the lamp at step 52, adding shelves proximal to the lamp to construct a point of sale display at step 54, heating the first and second lamp materials at step 56, closed loop controlling a temperature of the lamp to provide an ever changing display of shapes and motion to attract and hold the attention of shoppers at step 58, removing heat from the lamp and allowing the lamp to cool at step 60, removing the liquid second lamp material from the lamp, and disassembling the point of sale display at step 62. The liquid motion lamp may then be relocated to a new point of sale and reassembled for further use.

While the invention herein disclosed has been described by means of specific embodiments and applications thereof, numerous modifications and variations could be made thereto by those skilled in the art without departing from the scope of the invention set forth in the claims.

I claim:

1. A point of sale display comprising:

a liquid motion lamp comprising:

a lamp base portion;

a clear container extending vertically upward from the lamp base portion;

a first lamp material residing in the container, the first lamp material being in a solid phase at room temperature and in a liquid phase at a higher temperature;

a second lamp material residing in the container and adapted to cooperate with the first lamp material, which second material is in a liquid phase at room temperature has a lesser density than the first lamp material at room temperature, and a greater density than the first lamp material at the higher second temperature;

a top piece residing on top of the container; and a light and heat source residing in the lamp base portion cooperating thermally with the first and second lamp materials to heat the first and second lamp materials, wherein heating the lamp materials causes a portion of the first lamp material residing proximal to the lamp base portion to agglomerate and form globules which rise within the second lamp material and to cool proximal to the top piece and fall within the second lamp material back to the lamp base portion resulting in an ever-changing display of shapes and motion within the container;

second heat source wherein the light and heat source provides light and heat to the container and the second heat source provides heat only to the container;

a temperature sensor measuring a temperature of the liquid motion lamp for providing temperature measurements;

an electrical circuit electrically connected to the temperature sensor and to the light and heat source for controlling power provided to the light and heat source;

at least one shelf residing proximal to the liquid motion lamp and positioned between a shoppers area and the liquid motion lamp whereby the ever-changing motion of the lamp materials within the container attracts and retains the attention of shoppers; and products residing on the at least one shelf wherein the ever-changing motion of the lamp materials within the liquid motion lamp draws attention of shoppers to the products.

2. The point of sale display of claim 1, wherein the at least one shelf resides concentrically around the container of the liquid motion lamp.

3. The point of sale display of claim 1, wherein the at least one shelf is attached to the liquid motion lamp.

4. The point of sale display of claim 1, wherein the at least one shelf comprises at least two shelves positioned concentrically on the liquid motion lamp.

5. The point of sale display of claim 4, wherein:

the base portion of the liquid motion lamp includes a base flange for residing on a floor;

a first set of at least three parallel vertical posts extend vertically upward from the base flange outside the container to support a lower most shelf of the at least two shelves; and a second set of at least three parallel vertical posts extend vertically upward from the lower most shelf outside the container to support a center shelf of the at least two shelves.

6. The point of sale display of claim 5, wherein;

a vertically slidable base cover resided over the lamp base portion; and the base cover is slidable upwards to allow access to electronics in the lamp base portion.

7. The point of sale display of claim 6, wherein;

a lower most shelf of the at least two shelves is spaced apart from the container by a gap; and the vertically slidable base cover is slidable through the gap to allow greater access to electronics in the lamp base portion.

8. The point of sale display of claim 4, wherein the at least two shelves are round.

9. The point of sale display of claim 1, wherein the at least one shelf comprises a single shelf supported by the lamp base portion.

10. The point of sale display of claim 1, wherein upon cooling the liquid motion lamp to room temperature, the first lamp material returns to solid phase and collects in the bottom of the container and the second lamp material is removable from the liquid motion lamp.

11. A point of sale display comprising:

a liquid motion lamp comprising:

a lamp base portion including:

a base flange supported by a horizontal surface; and electronics providing light and heat;

a clear container extending vertically upward from the base portion and supported by the base portion and receiving the light and heat;

a first lamp material residing in the container, the first lamp material being in a solid phase at room temperature and in a liquid phase at a higher temperature;

a second lamp material residing in the container and adapted to cooperate with the first lamp material, which second material is in a liquid phase at room temperature has a lesser density than the first lamp material at room temperature, and a greater density than the first lamp material at the higher second temperature;

a top piece residing on top of the container, and the light and heat provided by the lamp base portion cooperating thermally with the first and second lamp materials to heat the first and second lamp materials, wherein heating the lamp materials causes a portion the first lamp material residing proximal to the lamp base portion to agglomerate and form globules which rise within the second lamp material and to cool proximal to the top piece and fall within the second lamp material back to the lamp base portion resulting in an ever-changing display of shapes and motion within the container;

at least two shelves residing concentric to the liquid motion lamp;

a first set of at least three parallel vertical posts extend vertically upward from the base flange outside the container to support a lower most shelf of the at least two shelves; and a second set of at least three parallel vertical posts extend vertically upward from the lower most shelf outside the container to support a center shelf of the at least two shelves; and products residing on the at least two shelves wherein the ever-changing shapes and motion of the lamp materials within the liquid motion lamp draws attention to the products.

12. The method of claim 11, wherein the base portion further includes a cylindrical base cover surrounding the base portion, wherein the base cover is vertically moveable to access elements within the base portion.

13. The method of claim 12, wherein the bottom most shelf is separated from the lamp by a gap and the base cover is slidable through the gap to allow greater access to electronics in the lamp base portion.

14. The method of claim 12, wherein the bottom most shelf is vertically positioned sufficiently high to allow the base cover to be lifted vertically to allow greater access to electronics in the lamp base portion.

15. The method of claim 11, wherein the shelves are supported by clear spacing cylinders.

16. A method for locating and relocating a point of sale display including a liquid motion lamp, the method comprising:

positioning a liquid motion lamp containing a solid phase first lamp material at a point of sale;

adding a liquid phase second lamp material to the lamp;

adding shelves proximal to the lamp to construct a point of sale display;

heating the first and second lamp materials;

closed loop controlling a temperature of the lamp to provide an ever changing display of shapes and motion to attract and hold the attention of shoppers;

removing heat from the lamp and allowing the lamp to cool;

removing the liquid second lamp material from the lamp;

disassembling the point of sale display;

relocating the point of sale display to a new point of sale; and reassembling the point of sale display at the new location.

17. The method of claim 16, further including assembling parallel vertical posts outside the lamp to support the shelves.

18. The method of claim 16, wherein closed loop controlling a temperature of the lamp comprises:

sensing a temperature of materials within the lamp; and determining a level of power to be provided to heaters within the lamp based on the sensed temperature.

19. The method of claim 18, wherein determining a level of power to be provided to heaters within the lamp based on the sensed temperature comprises determining a level of power to be provided to a light in a base of the lamp providing light and heat and a second heater submerged in the lamp materials providing heat, based on the sensed temperature.

* * * * *